US009940891B2

(12) United States Patent
Park et al.

(10) Patent No.: US 9,940,891 B2
(45) Date of Patent: Apr. 10, 2018

(54) DISPLAY APPARATUS

(71) Applicant: SAMSUNG DISPLAY CO., LTD., Yongin-si, Gyeonggi-Do (KR)

(72) Inventors: Junhyun Park, Suwon-si (KR); Kyoungju Shin, Hwaseong-si (KR)

(73) Assignee: SAMSUNG DISPLAY CO., LTD., Yongin-si, Gyeonggi-Do (KR)

( * ) Notice: Subject to any disclaimer, the term of this patent is extended or adjusted under 35 U.S.C. 154(b) by 164 days.

(21) Appl. No.: 14/965,221

(22) Filed: Dec. 10, 2015

(65) Prior Publication Data

US 2016/0307524 A1 Oct. 20, 2016

(30) Foreign Application Priority Data

Apr. 16, 2015 (KR) ..... 10-2015-0053969

(51) Int. Cl.
*G09G 3/26* (2006.01)
*G09G 3/36* (2006.01)

(52) U.S. Cl.
CPC ... *G09G 3/3688* (2013.01); *G09G 2300/0413* (2013.01); *G09G 2300/0452* (2013.01); *G09G 2310/0297* (2013.01); *G09G 2320/0223* (2013.01)

(58) Field of Classification Search
CPC . G11C 5/06; G09G 2310/0278; G09G 3/3688
See application file for complete search history.

(56) References Cited

U.S. PATENT DOCUMENTS

2003/0214476 A1* 11/2003 Matsuda ..... G09G 3/3688 345/100
2007/0057877 A1* 3/2007 Choi ..... G09G 3/3233 345/76
2011/0175858 A1* 7/2011 Lee ..... G09G 3/3688 345/204
2013/0127796 A1 5/2013 Li et al.
2013/0141320 A1 6/2013 Kim
2013/0169617 A1* 7/2013 Cheng ..... G09G 3/36 345/212
2014/0218347 A1* 8/2014 Lee ..... G02F 1/136286 345/211

FOREIGN PATENT DOCUMENTS

JP 2003270660 9/2003
JP 2005196133 7/2005
KR 1020090070324 7/2009
KR 1020130061884 6/2013

* cited by examiner

*Primary Examiner* — Gerald Johnson
(74) *Attorney, Agent, or Firm* — F. Chau & Associates, LLC

(57) ABSTRACT

A display apparatus includes a plurality of gate lines, a plurality of data lines, wherein the plurality of data lines includes a plurality of first and second data line pairs, a plurality of pixels connected to the gate lines and the data lines, driving lines connected to the second data lines, a plurality of switching elements connected to the first data lines and the driving lines, and a plurality of dummy elements respectively connected to a corresponding pair of the first and second data lines, wherein the switching elements and the dummy elements are turned on in response to a switching signal.

15 Claims, 11 Drawing Sheets

DISPLAY APPARATUS

CROSS-REFERENCE TO RELATED APPLICATION

This U.S. non-provisional patent application claims priority under 35 U.S.C. § 119 to Korean Patent Application No. 10-2015-0053969 filed Apr. 16, 2015, in the Korean Intellectual Property Office, the disclosure of which is incorporated by reference herein in its entirety.

TECHNICAL FIELD

The present inventive concept relates to a display apparatus.

DISCUSSION OF THE RELATED ART

An organic light-emitting display, a liquid crystal display, and an electrophoretic display are some examples of a display apparatus.

A display apparatus generally includes a display panel having a plurality of pixels to display an image, a gate driver to provide gate signals to the pixels, and a data driver to provide data voltages to the pixels.

In an example operation of the display apparatus, the pixels receive the gate signals through a plurality of gate lines. The pixels are charged with data voltages, which are received through a plurality of data lines, in response to the gate signals. Each pixel displays a grey scale corresponding to its charged data voltage. Then, an image can be displayed.

There is may be a resistive-capacitive (RC) delay that causes a signal delay on the signal lines of the display apparatus. This delay may be due to self resistance and parasitic capacitance. When the data voltages are supplied to the pixels through the data lines, the pixels may not be charged with the data voltages due to the RC delay.

SUMMARY

In an exemplary embodiment of the present inventive concept, a display apparatus may include a plurality of gate lines; a plurality of data lines, wherein the plurality of data lines include first and second data line pairs; a plurality of pixels connected to the gate lines and the data lines; driving lines connected to the second data lines; a plurality of switching elements connected to the first data lines and the driving lines; and a plurality of dummy elements respectively connected to a corresponding pair of the first and second data lines, wherein the switching elements and the dummy elements may be turned on in response to a switching signal.

The display apparatus may further include a switching line connected to the switching elements and the dummy elements and configured to receive the switching signal.

At least one of the switching elements may include a control terminal connected to the switching line, an input terminal connected to a corresponding driving line of the driving lines, and an output terminal connected to a first data line of a corresponding pair of the first and second data lines.

At least one of the dummy elements may include a control terminal connected to the switching line, an input terminal connected to a second data line of the corresponding pair of the first and second data lines, and an output terminal connected to a first data line of the corresponding pair of the first and second data lines.

A channel width of at least one of the switching element may be larger than a channel width of at least one of the dummy elements.

The switching elements and the dummy elements may include amorphous silicon thin-film transistors or oxide thin-film transistors.

The display apparatus may further include a display panel in which the pixels are disposed, a gate driver connected to the gate lines to output gate signals, a data driver connected to the driving lines to output data voltages, and a demultiplexer disposed between the data driver and the pixels, wherein the demultiplexer includes the switching elements and the dummy elements.

The gate lines may receive gate signals, the driving lines may receive data voltages, and the pixels may be charged with the data voltages which are provided through the driving lines and the first and second data lines in response to the gate signals.

The pixels may include a plurality of first pixels connected to the first data lines, and a plurality of second pixels connected to the second data lines.

At least one period of the gate signals may include a first period in which the first pixels are charged, and a second period in which the second pixels are charged.

The switching signal may be provided to the switching elements and the dummy elements during the first period.

The first period may be about 0.5 to about 0.9 times of a period of the gate signal.

The switching signal may include a first switching signal provided to the switching elements during the first period, and a dummy switching signal provided to the dummy elements, wherein the dummy switching signal may overlap with the first switching signal in a subperiod of the first period.

The display apparatus may further include a dummy switching line connected to the dummy elements to receive the dummy switching signal.

The first period may include a first subperiod, a second subperiod, and a third subperiod, the second subperiod may be interposed between the first subperiod and the third subperiod, and the dummy switching signal may be provided to the dummy elements during the second subperiod.

In an exemplary embodiment of the present inventive concept, a display apparatus may include a plurality of gate lines configured to receive gate signals, a plurality of data lines including a plurality of data line groups each data line group including first data lines, second data lines, and third data lines, a plurality of driving lines configured to receive data voltages and connected to the third data lines, a plurality of pixels connected to the gate lines and the data line groups, a plurality of first switching elements connected to the first data lines and the driving lines, a plurality of second switching elements connected to the second data lines and the driving lines, a plurality of first dummy elements connected to the first and third data lines of a corresponding data line group, and a plurality of second dummy elements connected to the second and third data lines of a corresponding data line group, wherein the first switching elements and the second dummy elements may be turned on in response to a first switching signal, and the second switching elements and the second dummy elements may be turned on in response to a second switching signal.

The display apparatus may further include: a first switching line connected to the first switching elements and the first dummy elements and configured to receive the first switching signal; and a second switching line connected to the second switching elements and the second dummy elements and configured to receive the second switching signal.

A channel width of each of the first and second switching elements is larger than a channel width of each of the first and second dummy elements.

The pixels may include: a plurality of first pixels connected to the first data lines; a plurality of second pixels connected to the second data lines; a plurality of third pixels connected to the third data lines, wherein at least one period of the gate signals includes: a first period in which the first pixels are charged; a second period in which the second pixels are charged; and a third period in which the third pixels are charged.

The first switching signal may be provided to the first switching elements and the first dummy elements during the first period, and the second switching signal may be provided to the second switching elements and the second dummy elements during the second period.

In an exemplary embodiment of the present inventive concept, a display apparatus may include: first and second data lines adjacent to each other; a driving line connected to the first and second data lines; a first switch connected to the first data line and configured to be turned on in response to a switch signal; a second switch connected to the first and second data lines and configured to be turned on in response to the switch signal; and a first pixel connected to a gate line and the first data line, wherein when the first and second switches are turned on by the switch signal in a first period of a gate signal, the first pixel receives a charge provided through the first and second switches.

The display apparatus may include a second pixel connected to the gate line and the second data line, wherein in a second period of the gate signal in which the first and second switches are turned off, the second pixel receives a charge provided through the second data line.

A channel width of the first switch may be larger than a channel width of the second switch.

DETAILED DESCRIPTION OF THE EMBODIMENTS

Figure 1:
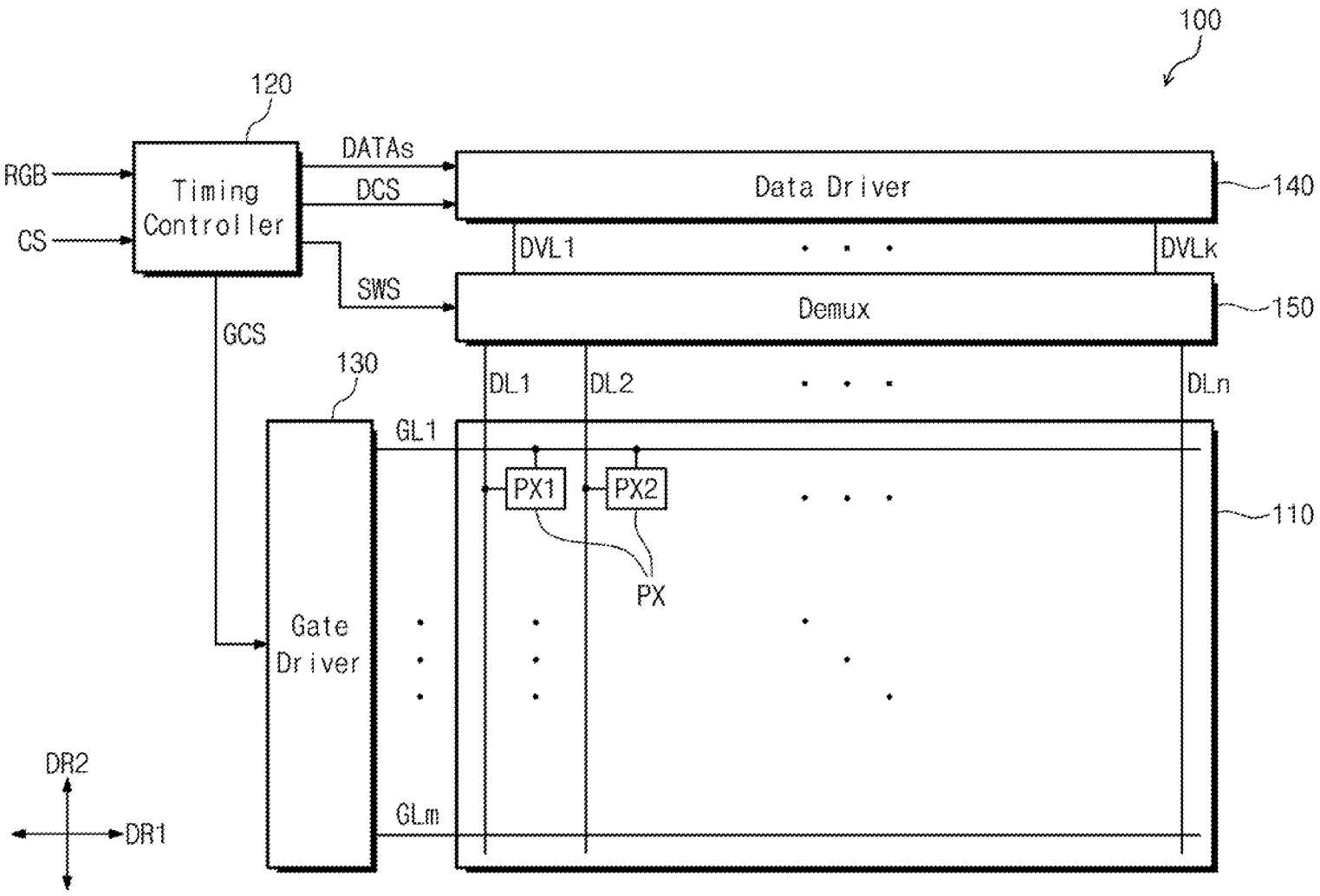
FIG. 1 is a block diagram illustrating a display apparatus according to an exemplary embodiment of the present inventive concept.

Exemplary embodiments of the present inventive concept will be described in detail hereinafter in conjunction with the accompanying drawings. The present inventive concept, however, may be embodied in various different forms, and should not be construed as being limited only to the illustrated embodiments. Like reference numerals may denote the same elements throughout the attached drawings and written description.

FIG. 1 is a block diagram illustrating a display apparatus 100 according to an exemplary embodiment of the inventive concept.

Referring to FIG. 1, the display apparatus 100 may include a display panel 110, a timing controller 120, a gate driver 130, a data driver 140, and a demultiplexer (demux) 150.

The display panel 110 may be one of various kinds of display panels such as an electrophoretic display panel including an electrophoretic layer, an electrowetting display panel including an electrowetting layer, or an organic light-emitting display panel including an organic light emitting layer.

For discussion purposes, the display panel 110 shown in FIG. 1 may be a liquid crystal display panel which includes a first substrate, a second substrate, and a liquid crystal layer interposed between the first substrate and the second substrate.

The display panel 110 may include a plurality of gate lines GL1~GLm, a plurality of data lines DL1~DLn, and a plurality of pixels PX. The gate lines GL1~GLm may extend along a first direction DR1 and be connected to the gate driver 130. The data lines DL1~DLn may extend along a second direction DR2, which intersects the first direction DR1, and be connected to the demultiplexer 150. The variables m and n are natural numbers.

The data lines DL1~DLn may include first and second data lines which are alternately disposed with respect to each other. For example, the data lines DL1~DLn may include a plurality of first data lines DL1, DL3, . . . , and DLn-1 (hereinafter, referred to as 'DL1~DLn-1') which are odd-numbered data lines of the data lines DL1~DLn and a plurality of second data lines DL2, DL4, . . . , and DLn (hereinafter, referred to as 'DL2~DLn') which are even-numbered data lines of the data lines DL1~DLn.

The pixels PX may include a plurality of first pixels PX1 connected to the first data lines DL1~DLn-1 and a plurality of second pixels PX2 connected to the second data lines DL2~DLn.

The data driver 140 may be connected to a plurality of driving lines DVL1~DVLk. The variable k may be a natural number that is n/2. The driving lines DVL1~DVLk may extend along the second direction DR2 between the data driver 140 and the demultiplexer 150, and connect with the data driver 140 and the demultiplexer 150.

The pixels PX may be disposed in areas which are comparted by the gate lines GL1~GLm and the data lines DL1~DLn which intersect each other. The pixels PX may be arranged in the form of a matrix. The pixels PX may be connected to the data lines DL1~DLn.

Each pixel PX may display one of the primary colors. The primary colors may include red, green, blue, and white. However, an exemplary embodiment of the present inventive concept may not be restricted thereto, and the primary colors may further include other colors such as yellow, cyan, and magenta.

The timing controller 120 may receive image signals RGB and a control signal CS from external (e.g., system board) device. For example, the external device may be a device that is different from the timing controller 120. The timing controller 120 may convert a data format of the image signals RGB to a data format appropriate for an interface between the timing controller 120 and the data driver 140. The timing controller 120 may provide image data DATAs, which are converted in the appropriate data format, to the data driver 140.

The timing controller 120 may generate a gate control signal GCS, a data control signal DCS, and a switching signal SWS in response to the control signal CS.

The gate control signal GCS may be a control signal for controlling an operation timing of the gate driver 130. The data control signal DCS may be a control signal for controlling an operation timing of the data driver 140. The switching signal SWS may be a control signal for controlling an operation of the demultiplexer 150.

The timing controller 120 may provide the gate control signal GCS to the gate driver 130, and provide the data control signal DCS to the data driver 140. The timing controller 120 may provide the switching signal SWS to the demultiplexer 150.

The gate driver 130 may generate and output gate signals in response to the gate control signal GCS. The gate driver 130 may output the gate signals in sequence. The gate signals may be provided to the pixels PX in the unit of row through the gate lines GL1~GLm. Each gate signal may include a first period and a second period.

The data driver 140 may generate and output analog data voltages, which correspond to the image data DATAs, in response to the data control signal DCS. The data voltages may be provided to the demultiplexer 150 through the driving lines DVL1~DVLk.

The demultiplexer 150 may provide the data voltages to the first pixels PX1 through the first data lines DL1~DLn-1 during the first period (of the gate signals) in response to the switching signal SWS. The demultiplexer 150 may provide the data voltages to the second pixels PX2 through the second data lines DL2~DLn during the second period (of the gate lines) in response to the switching signal SWS.

The pixels PX receive the data voltages in response to the gate signals and charge the data voltages therein. The pixels PX may display grey scales, corresponding to the charged data voltages, to display an image.

In an exemplary embodiment of the inventive concept, an amount of current that is provided to the data lines DL1~DLn through the demultiplexer 150 may be increased. Accordingly, a charge rate of the pixels PX may be increased. This will be described later in more detail.

The timing controller 120 may be arranged on a printed circuit board in a form of integrated circuit chip to connect with the gate driver 130 and the data driver 140.

The gate driver 130 and the data driver 140 may be formed of a plurality of driving chips on a flexible printed circuit board, and may be connected to the display panel 110 in a type of Tape Carrier Package (TCP).

Further, the gate driver 130 and the data driver 140 may be formed of a plurality of driving chips on the display panel 110 in a type of Chip-On-Glass (COG).

Additionally, the gate driver 130 may be formed together with transistors of the pixels PX on the display panel 110 in a type of Amorphous Silicon Gate (ASG) driver circuit or an Oxide Silicon Thin Film Gate (OSG) driver circuit. Transistors of the gate driver 130 may include amorphous silicon thin film transistors or oxide thin film transistors having oxide semiconductors.

The demultiplexer 150 may be disposed between the data driver 140 and the pixels PX on the display panel 110.

Figure 2:
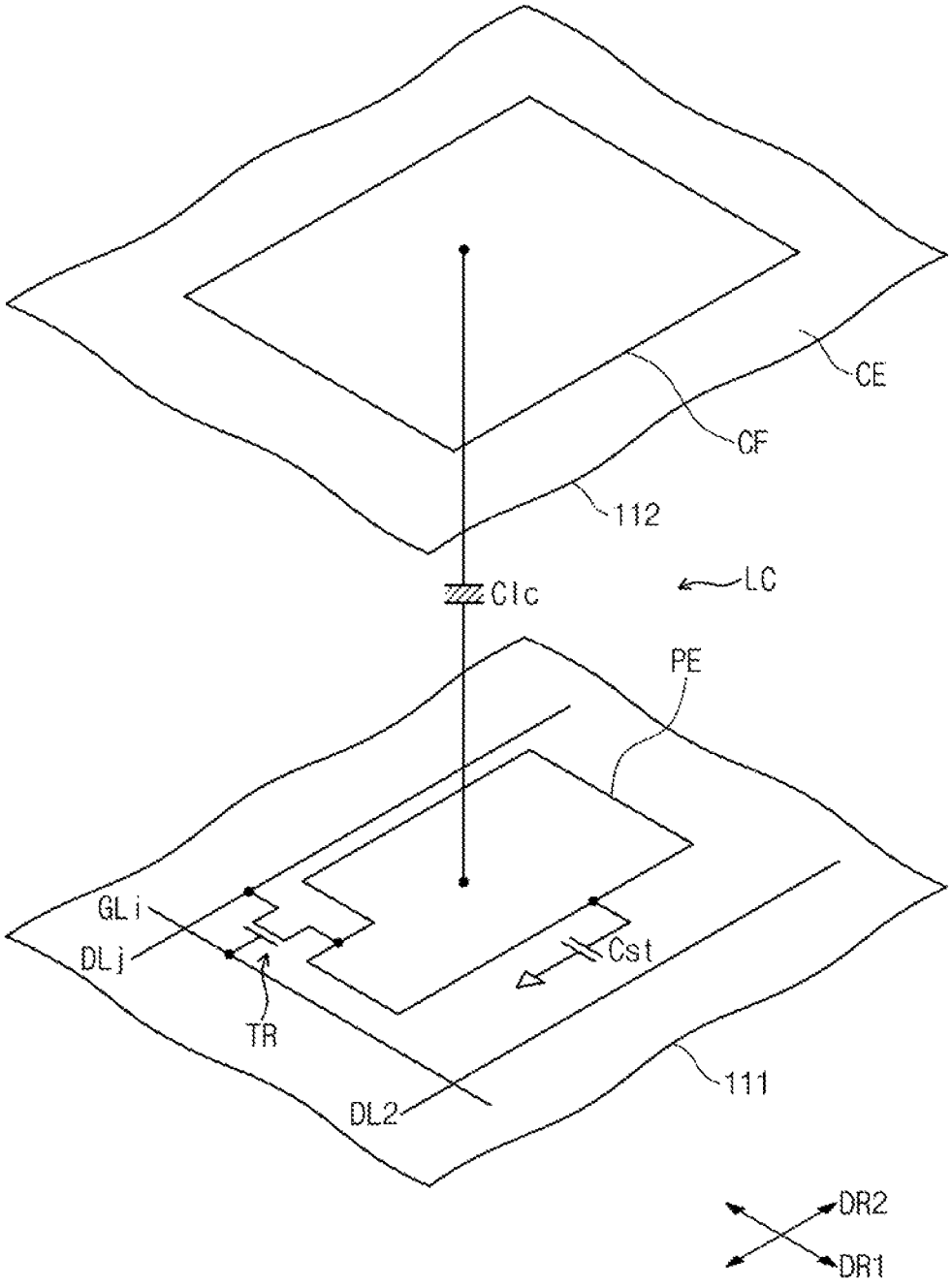
FIG. 2 is a diagram illustrating a configuration of a pixel shown in FIG. 1, according to an exemplary embodiment of the present inventive concept.

FIG. 2 is a diagram illustrating a configuration of the pixel PX shown in FIG. 1, according to an exemplary embodiment of the present inventive concept.

For convenience of description, FIG. 2 shows the pixel PX connected to a gate line GLi and a data line DLj. Although not shown, configurations of other pixels of the display panel 110 may be substantially identical to the pixel PX shown in FIG. 2.

Referring to FIG. 2, the display panel 110 may include a first substrate 111, a second substrate 112 facing the first substrate 111, and a liquid crystal layer LC interposed between the first substrate 111 and the second substrate 112.

The pixel PX may include a transistor TR connected to the gate line GLi and the data line DLj, a liquid crystal capacitor Clc connected to the transistor TR, and a storage capacitor Cst connected to the liquid crystal capacitor Clc in parallel. The storage capacitor Cst may be excluded. The variables i and j are natural numbers.

The transistor TR may be disposed in the first substrate 111. The transistor TR may include a gate electrode connected to the gate line GLi, a source electrode connected to the data line DLj, and a drain electrode connected to the liquid crystal capacitor Clc and the storage capacitor Cst.

The liquid crystal capacitor Clc may include a pixel electrode PE disposed in the first substrate 111, a common electrode CE disposed in the second substrate 112, and the liquid crystal layer LC interposed between the pixel electrode PE and the common electrode CE. The liquid crystal layer LC may act as a dielectric. The pixel electrode PE may be connected to the drain electrode of the transistor TR.

While the pixel electrode PE is configured in a non-slit structure in FIG. 2, the pixel electrode PE may not be restricted thereto. For example, the pixel electrode PE may have a slit structure which includes a crossed stem part and a plurality of branch parts extending radially from the crossed stem part.

The common electrode CE may be entirely formed over the second substrate 112. Additionally, the common electrode CE may be disposed in the first substrate 111. When the common electrode CE is disposed in the first substrate 111, at least one of the pixel electrode PE and the common electrode CE may include a slit.

The storage capacitor Cst may include a pixel electrode PE, a storage electrode branching out from a storage line, and an insulation layer interposed between the pixel electrode PE and the storage electrode. The storage line may be disposed in the first substrate 111 and formed in the same layer with the gate lines GL1~GLm. The storage electrode may be partly overlaid with the pixel electrode PE.

The pixel PX may further include a color filter CF which indicates one of primary colors. In an exemplary embodiment of the present inventive concept, the color filter CF may be disposed in the second substrate 112 as shown in FIG. 2. However, the color filter CF may be disposed in the first substrate 111.

The transistor TR may be turned on in response to a gate signal which is provided from the gate line GLi. A data voltage received from the data line DLj may be provided to the pixel electrode PE of the liquid crystal capacitor Clc through the transistor TR which is being turned on.

Due to a difference between a data voltage and a common voltage, an electric field may be generated between the pixel electrode PE and the common electrode CE. The electric field between the pixel electrode PE and the common electrode CE may drive liquid crystal molecules of the liquid crystal layer LC. The liquid crystal molecules driven by the electric field may adjust optical transmittance to display an image. A backlight may be disposed at the rear side of the display panel 110 to provide light to the display panel 110.

A storage voltage with a constant voltage level may be applied to the storage line. Additionally, the storage line may receive a common voltage. The storage capacitor Cst may compensate a voltage which is charged in the liquid crystal capacitor Clc.

Figure 3:
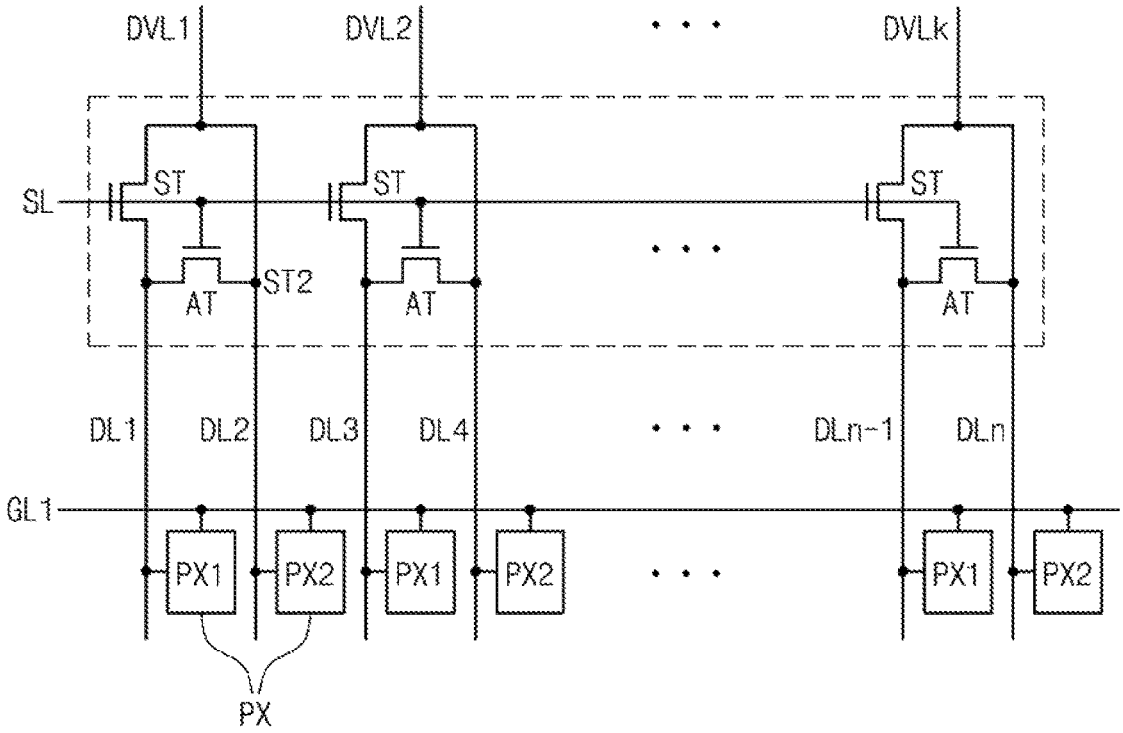
FIG. 3 is a diagram illustrating a configuration of a demultiplexer shown in FIG. 1, according to an exemplary embodiment of the present inventive concept.
Figure 4:
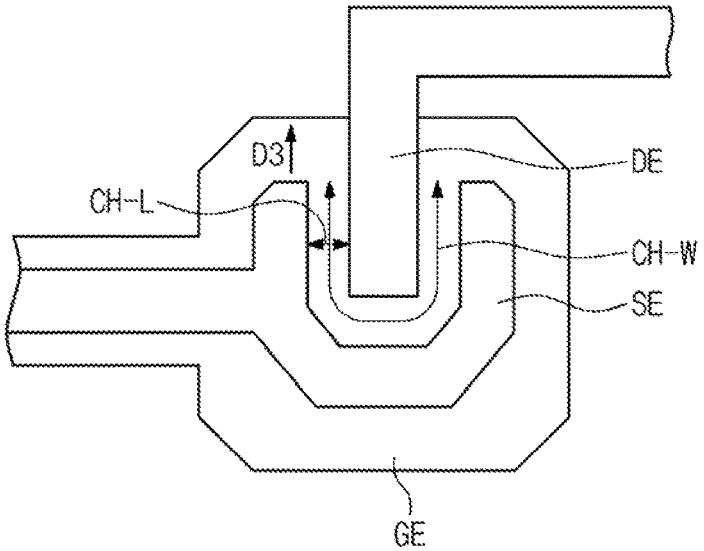
FIG. 4 is a diagram illustrating a channel width of switching elements shown in FIG. 3, according to an exemplary embodiment of the present inventive concept.

FIG. 3 is a diagram illustrating a configuration of the demultiplexer 150 shown in FIG. 1, according to an exemplary embodiment of the present inventive concept. FIG. 4 is a diagram illustrating a channel width of switching elements shown in FIG. 3, according to an exemplary embodiment of the present inventive concept.

For convenience of description, FIG. 3 just shows the pixels PX which are connected to the first gate line GL1 of the gate lines GL1~GLm.

Referring to FIG. 3, the demultiplexer 150 may include a plurality of switching elements ST and a plurality of dummy elements AT. In an exemplary embodiment of the present inventive concept, the switching elements ST and the dummy elements AT may be N-type transistors. Additionally, the switching elements ST and the dummy elements AT may be P-type transistors.

The switching elements ST and the dummy elements AT may include amorphous silicon thin film transistors or oxide thin film transistors having oxide semiconductors.

The switching elements ST may be connected to the driving lines DVL1~DVLk and the first data lines DL1~DLn-1. Each dummy element AT may be correspondingly connected to a pair of the first and second data lines of the data lines DL1~DLn.

The switching elements ST and the dummy elements AT may be connected to a switching line SL which receives a switching signal. The second data lines DL2~DLn may be connected to the driving lines DVL1~DVLk.

The switching elements ST may connect the driving lines DVL1~DVLk with the first data lines DL1~DLn-1 in response to a switching signal which is provided through the switching line SL. Each dummy element AT may correspondingly connect a pair of the first and second data lines of the data lines DL1~DLn to each other in response to a switching signal which is provided through the switching line SL.

Each switching element ST may include a control terminal (e.g., a gate terminal) connected to the switching line SL, an input terminal (e.g., a drain or a source terminal) connected to a corresponding driving line of the driving lines DVL1~DVLk, and an output terminal (e.g., a source or a drain terminal) connected to a corresponding first data line of the first data lines DL1~DLn-1.

Each dummy element AT may be disposed between the corresponding pair of the first data line and the second data line. Each dummy element AT may include a control terminal (e.g., a gate terminal) connected to the switching line SL, an input terminal (e.g., a drain or a source terminal) connected to a corresponding second data line of the second data lines DL2~DLn, and an output terminal (e.g., a source or a drain terminal) connected to a corresponding first data line of the first data lines DL1~DLn-1.

Referring to FIG. 4, the switching element ST may include a gate electrode GE, and a source electrode SE and a drain electrode DE which are isolated from each other and overlaid with the gate electrode GE. The gate electrode GE may be connected to the switching line SL, the source electrode SE may be connected to a corresponding driving line of the driving lines DVL1~DVLk, and the drain electrode DE may be connected to a corresponding first data line of the first data lines DL1~DLn-1.

An interval between the source electrode SE and the drain electrode DE in the switching device ST may be referred to as a channel length CH-L. A length of the path between the source electrode SE and the drain electrode DE in the switching element ST may be referred to as a channel width CH-W.

If the channel width CH-W increases, an amount of current flowing into the drain electrode DE from the source electrode SE may increase. For example, if the protruding parts of the source electrode SE are extended from their current position in a third direction D3, the channel width CH-W may increase and the amount of current flowing into the drain electrode DE from the source electrode SE may increase. Additionally, if the protruding parts of the source electrode SE are shortened, the channel width CH-W may decrease and the amount of current flowing into the drain electrode DE from the source electrode SE may decrease.

While FIG. 4 illustrates the channel width CH-W of the switching element ST, it is to be understood that a channel width of the dummy element AT may be similarly formed. In an exemplary embodiment of the present inventive concept, the channel width of the switching element ST may be larger than the channel width of the dummy element AT.

Figure 5:
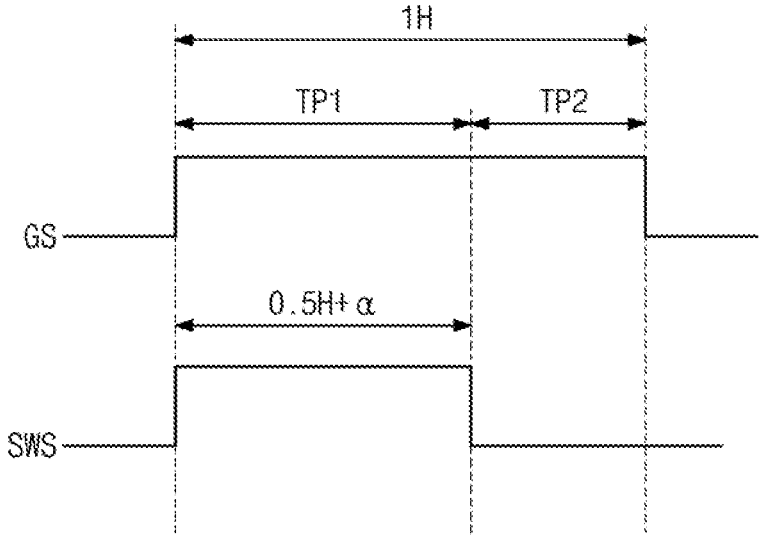
FIG. 5 is a timing diagram illustrating an operation of the demultiplexer shown in FIG. 3, according to an exemplary embodiment of the present inventive concept.
Figure 6:
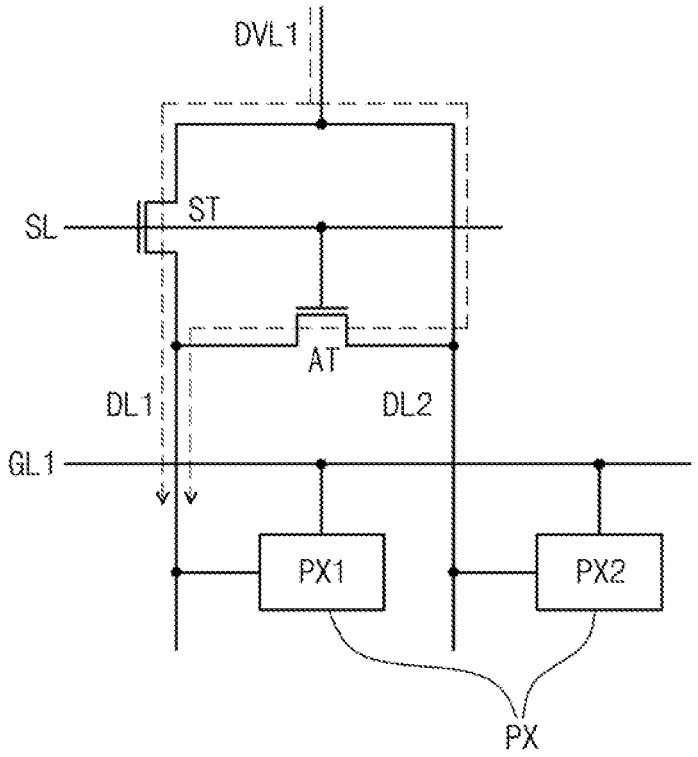
FIGS. 6 and 7 are diagrams illustrating the operation of the demultiplexer shown in FIG. 3 in accordance with the timing diagram shown in FIG. 5, according to an exemplary embodiment of the present inventive concept.
Figure 7:
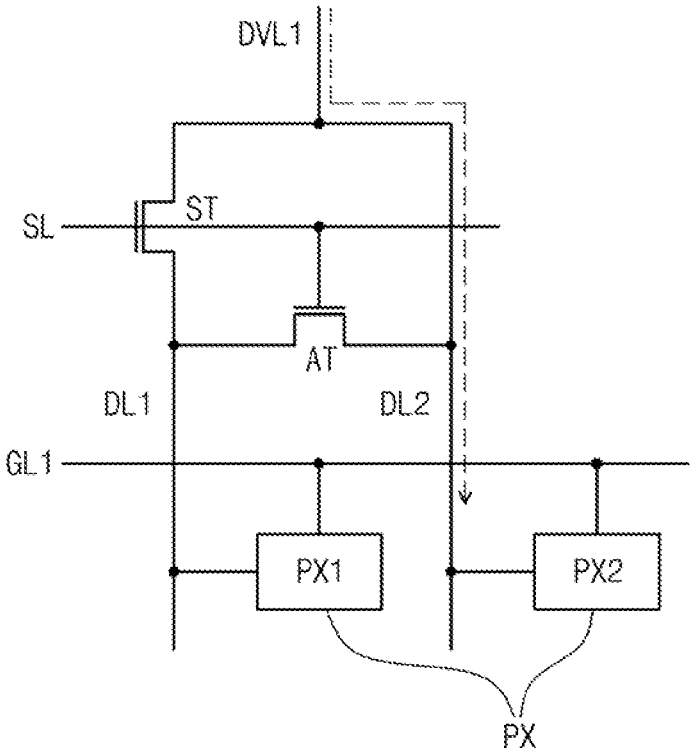

FIG. 5 is a timing diagram illustrating an operation of the demultiplexer shown in FIG. 3, according to an exemplary embodiment of the present inventive concept. FIGS. 6 and 7 are diagrams illustrating the operation of the demultiplexer shown in FIG. 3 in accordance with the timing diagram shown in FIG. 5, according to an exemplary embodiment of the present inventive concept.

For convenience of description, FIGS. 6 and 7 just show a driving line DVL1, a pair of the first and second data lines DL1 and DL2, a switching element ST and a dummy element AT which are connected to the first and second data lines DL1 and DL2, and first and second pixels PX1 and PX2 which are connected to the first and second data lines DL1 and DL2.

Referring to FIG. 5, a period 1 H of a gate signal GS applied to each of the gate lines GL1~GLm may include a first period TP1 and a second period TP2. The period 1 H of the gate signal GS may be a high-level period (or an active period) of the gate signal GS.

The first period TP1 may be 0.5 H+α of the period 1 H of the gate signal GS. The factor α may be larger than or equal to 0, and smaller than or equal to 0.4 H. In other words, the first period TP1 may be set to a range of 0.5 H to 0.9 H.

The switching signal SWS may have a high level (or active level) during the first period TP1. The first period TP1 may be a high-level period of the switching signal SWS. The switching signal SWS may be provided to the switching element ST and the dummy element AT through the switching line SL during the first period TP1. The switching element ST and the dummy element AT may be turned on during the first period TP1 in response to the switching signal SWS.

During the second period TP2, the switching element ST and the dummy element AT may receive a low level (or inactive level) of the switching signal SWS and may be turned off in response to the received low level of the switching signal SWS.

Referring to FIG. 6, the driving line DVL1 may be connected to the first data line DL1 through the switching element ST which is turned on. The second data line DL2 connected to the driving line DVL1 may be connected to the first data line DL1 through the dummy element AT which is turned on.

During the first period TP1, a first data voltage to be provided to the first pixel PX1 may be applied to the driving line DVL1. The first data voltage applied to the driving line DVL1 may be applied to the first data line DL1 through the switching element ST and the dummy element AT. Accordingly, the first data voltage may be provided to the first pixel PX1, which is connected to the first data line DL1, and charged in the first pixel PX1.

A current corresponding to a channel size of the switching element ST may flow through the switching element ST. A current corresponding to a channel size of the dummy element AT may flow through the dummy element AT.

Because the switching element ST and the dummy element AT which are turned on, the driving line DVL1 and the second data line DL2 may be connected in parallel with the first data line DL1. Accordingly, the current flowing through the switching element ST and the current flowing through the dummy element AT may be summed up at the first data line DL1 and then provided into the first pixel PX1.

If the dummy element AT is not used, only the current flowing through the switching element ST may be provided into the first pixel PX1 through the first data line DL1.

In an exemplary embodiment of the inventive concept, the current flowing through the switching element ST and the current flowing through the dummy element AT may be summed up and then provided into the first pixel PX1. In other words, an amount of current provided to the first data lines DL1~DLn-1 through the demultiplexer 150 may be increased. Therefore, a charge rate of the first pixel PX1 may be increased.

Referring to FIG. 7, during the second period TP2, the switching element ST and the dummy element AT may be turned off. During the second period TP2, a second data voltage to be provided to the second pixel PX2 may be applied to the driving line DVL1. The second data voltage applied to the driving line DVL1 may be provided to the second pixel PX2 through the second data line DL2.

Although the first data voltage can be applied to the second pixel PX2 during the first period TP1, the second data voltage may be provided and charged into the second pixel PX2 during the second period TP2. Accordingly, since the second data voltage is provided and charged into the second pixel PX2 during the second period TP2 after the first data voltage is applied to the second pixel PX2 during the first period TP1, the second pixel PX2 may display an image normally.

Without including the dummy element AT, an additional switching element may be used to connect the driving line DVL1 with the second data line DL2 in response to an additional switching signal during the second period TP2. Hereinafter, an additional switching element will be referred to as "a first comparison element". In this configuration, a current may flow through the first comparison element and then flow into the second pixel PX2 through the second data line DL2. For example, the first comparison element may be connected between the driving line DVL1 and the second pixel PX2. Since the first comparison element has predetermined internal resistance, an amount of current which flows through the first comparison element and flows into the second pixel PX2 through the second data line DL2 may be reduced.

Additionally, in the embodiment of the inventive concept shown in FIGS. 6 and 7, since a current is provided directly into the second pixel PX2 through the second data line DL2, an amount of current applied to the second data line DL2 may increase more than in the case of using the first comparison element. In other words, an amount of current provided to the second data lines DL2~DLn through the demultiplexer 150 may be increased. Therefore, a charge rate of the second pixel PX2 may be increased.

Consequently, the display apparatus 100 described with reference to FIGS. 1 to 7 may be increase a charge rate of the pixel PX.

Figure 8:
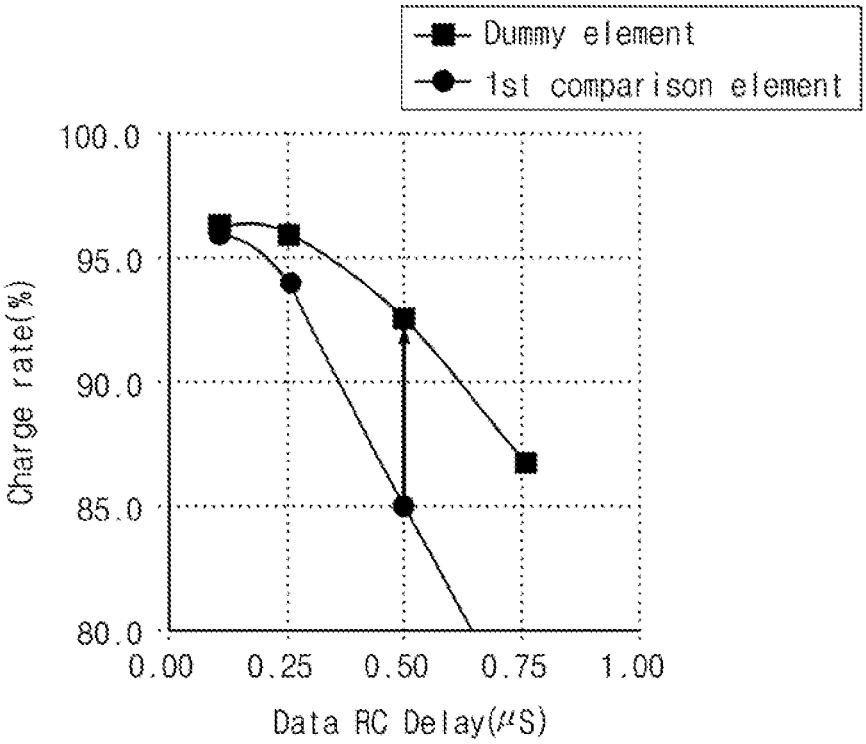
FIG. 8 is a diagram illustrating charge rates of first pixels when a switching element and a dummy element are used, and when a switching element and a first comparison element are used, according to an exemplary embodiment of the present inventive concept.
Figure 9:
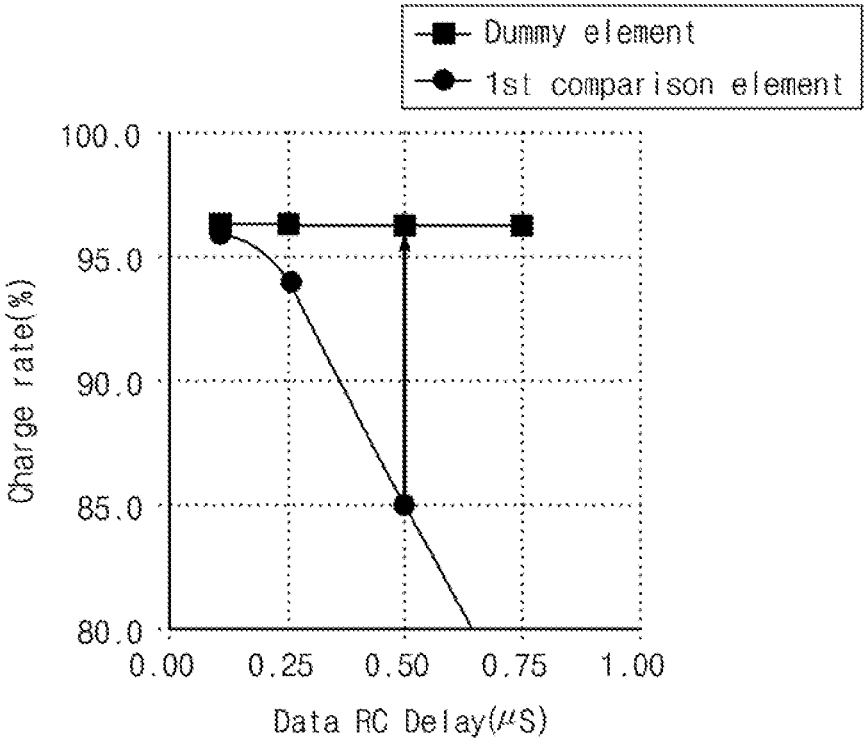
FIG. 9 is a diagram illustrating charge rates of second pixels when a switching element and a dummy element are used, and when a switching element and a first comparison element are used, according to an exemplary embodiment of the present inventive concept.

FIG. 8 is a diagram illustrating charge rates of the first pixels PX1 when the switching element and the dummy element are used, and when the switching element ST and the first comparison element are used, according to an exemplary embodiment of the present inventive concept. FIG. 9 is a diagram illustrating charge rates of the second pixels PX2 when the switching element ST and the dummy element DT are used, and when the switching element ST and the first comparison element are used, according to an exemplary embodiment of the present inventive concept.

In FIGS. 8 and 9, the horizontal axis indicates resistive-capacitive (RC) delay values and the vertical axis indicates charge rates of the pixel PX.

Referring to FIG. 8, the charge rates of the first pixel PX1 are higher when the dummy element AT is used than when the first comparison element is used. For example, if an RC delay is valued at 0.50 μs, the charge rate of the first pixel PX1 is higher by about 7.5% when the dummy element AT is used than when the first comparison element is used.

Referring to FIG. 9, the charge rates of the second pixel PX2 are higher when the dummy element AT is used than when the first comparison element is used. For example, if an RC delay is valued at 0.50 μs, the charge rate of the second pixel PX2 is higher by about 11% when the dummy element AT is used than when the first comparison element is used.

Figure 10:
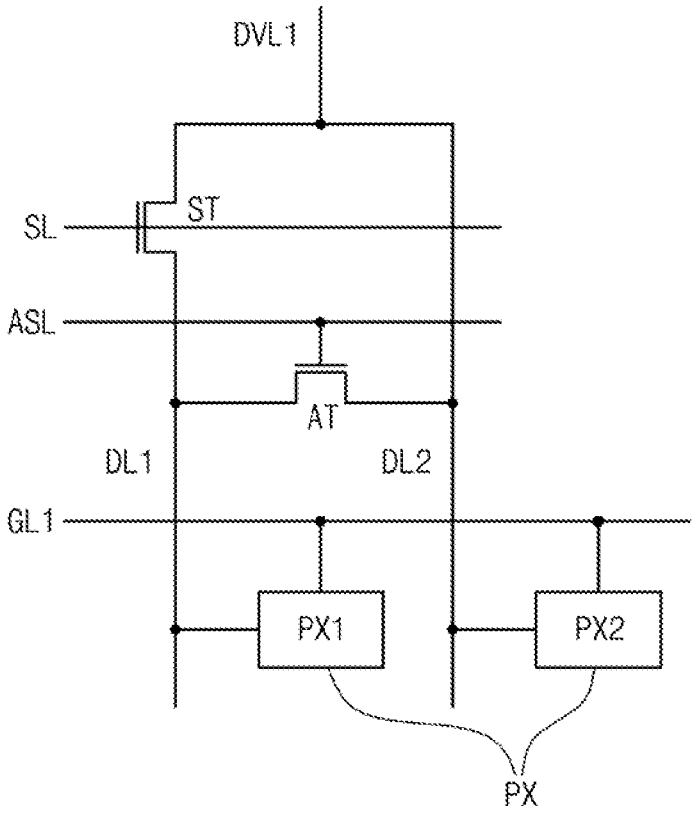
FIG. 10 is a diagram illustrating a part of a demultiplexer of a display apparatus according an exemplary embodiment of the inventive concept.
Figure 11:
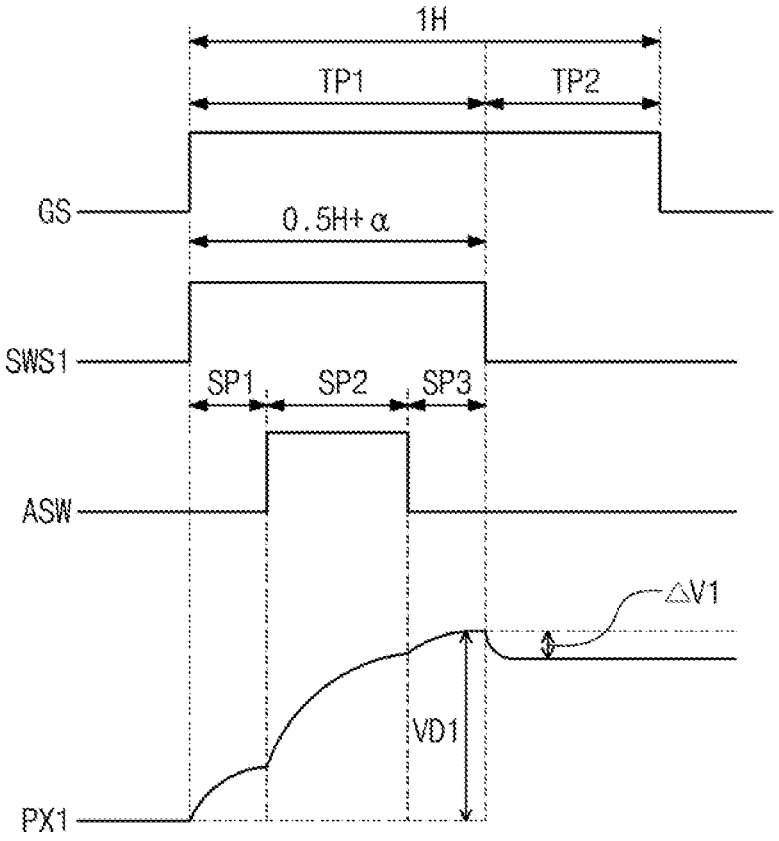
FIG. 11 is a timing diagram illustrating an operation of the demultiplexer shown in FIG. 10, according to an exemplary embodiment of the present inventive concept.

FIG. 10 is a diagram illustrating a part of a demultiplexer of a display apparatus according an exemplary embodiment of the inventive concept. FIG. 11 is a timing diagram illustrating an operation of the demultiplexer shown in FIG. 10, according to an exemplary embodiment of the present inventive concept.

For convenience of description, FIG. 10 just shows a driving line DVL1, a pair of first and second data lines DL1 and DL2, a switching element ST and a dummy element AT which are connected to the first and second data lines DL1 and DL2, and first and second pixels PX1 and PX2 which are connected to the first and second data lines DL1 and DL2.

The display apparatus described with reference to FIGS. 10 and 11 may be similar to the display apparatus 100 described with reference to FIGS. 1 to 7, except for a connection of the dummy element AT of the demultiplexer.

Referring to FIGS. 10 and 11, the dummy element AT may be disposed between a pair of the first data line DL1 and the second data line DL2. The dummy element AT may include a control terminal (e.g., a gate terminal) connected to a dummy switching line ASL, an input terminal (e.g., a drain or a source terminal) connected to the second data line DL2, and an output terminal (e.g., a source or a drain terminal) connected to the first data line DL1.

The channel width of the switching element ST may be larger than the channel width of the dummy element AT. The switching signal SWS may include a first switching signal SWS1 which is applied to a switching line SL, and a dummy switching signal ASW which is applied to the dummy switching line ASL. The dummy switching signal ASW may overlap with a predetermined period of the first switching signal SWS1.

During a first period TP1, the first switching signal SWS1 may be provided to the switching element ST through the switching line SL. The switching element ST may be turned on in response to the first switching signal SWS1. The switching element ST, which is turned on, may connect the driving line DVL1 with the first data line D11.

The first period TP1 may include a first subperiod SP1, a second subperiod SP2, and a third subperiod SP3. The second subperiod SP2 may be interposed between the first subperiod SP1 and the third subperiod SP3.

The dummy switching signal ASW may be set at a high level (active) during the second subperiod SP2. During the second subperiod SP2, the dummy switching signal ASW may be provided to the dummy element AT through the dummy switching line ASL.

The dummy element AT may be turned on during the second subperiod SP2 in response to the dummy switching signal ASW. The dummy element AT, which is turned on, may connect the first data line DL1 with the second data line DL2 which is connected to the driving line DVL1.

During the first subperiod SP1 and the third subperiod SP3, the dummy switching signal ASW may be set at a low level (inactive). Accordingly, the dummy element AT may be turned off during the first subperiod SP1 and the third subperiod SP3.

In the first subperiod SP1, a current flowing through the switching element ST may be provided to the pixel PX1 through the first data line DL1 and thereby the first pixel PX1 may be charged with a predetermined voltage level.

During the second subperiod SP2, the switching element ST and the dummy element AT are both turned on. Thus, a current flowing through the switching element ST and the dummy element AT may be provided to the first pixel PX1 through the first data line DL1 in the second subperiod SP2. Accordingly, the first pixel PX1 may be charged to reach a predetermined voltage level higher than that of the first subperiod SP1.

A current flowing through the switching element ST may be provided to the first pixel PX1 through the first data line DL1 in the third subperiod SP3, and the pixel PX1 may be charged to reach a level of the first data voltage VD1 which is higher than that reached in the second subperiod SP2.

At a termination point of the first switching signal SWS1 where the first switching signal SWS1 transitions to a low level from a high level, a kickback voltage of the switching element ST may decrease a level of the first data voltage VD1, which is charged in the first pixel PX1, by as much as a first kickback voltage ΔV1.

The first kickback voltage ΔV1 has a value corresponding to an amplitude of the kickback voltage of the switching element ST. The kickback voltage may refer to a voltage generated by a parasitic capacitance between a gate electrode and a source electrode in a transistor. In this case, transistor is the switching element ST.

During the second period TP2, a second data voltage applied to the driving line DVL1 may be provided and charged into the second pixel PX2 through the second data line DL2.

Without including the dummy element AT, the switching element ST may be replaced with another switching element which has a channel width as large as the sum of the channel widths of the switching element ST and the dummy element AT. This switching element will be referred to as "a second comparison element". It is to be understood that the kickback voltage increases with the channel width.

Figure 12:
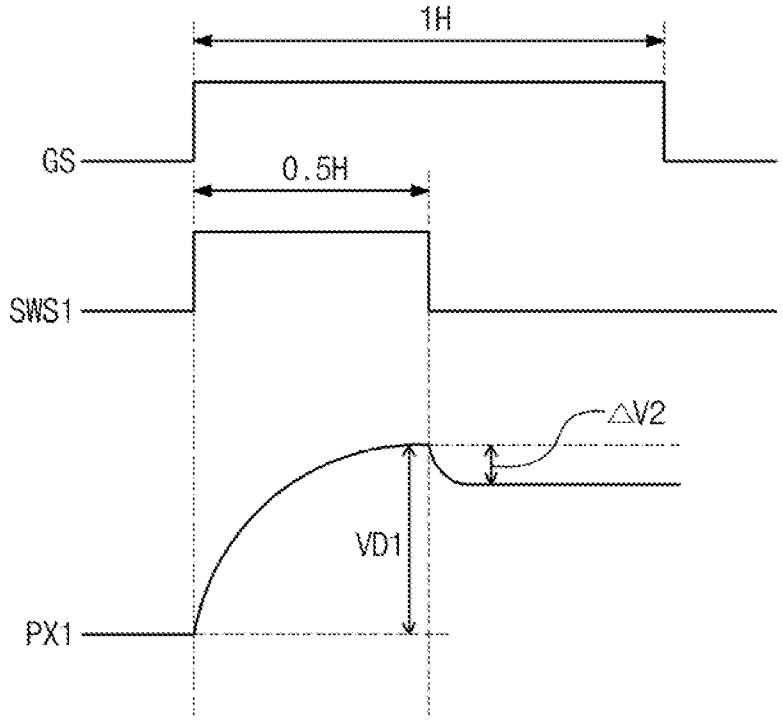
FIG. 12 is a diagram illustrating charge timing when a second comparison element is used, according to an exemplary embodiment of the present inventive concept.

FIG. 12 is a diagram illustrating charge timing when a second comparison element is used, according to an exemplary embodiment of the present inventive concept.

Referring to FIG. 12, a current flowing through the second comparison element which is turned on by the first switching signal SWS1 may be charged into the first pixel PX1 through the first data line DL 1. The first pixel PX1 may be charged with the first data voltage VD1.

At a termination point of the first switching signal SWS1, a level of the first data voltage VD1, which is charged in the first pixel PX1, may decrease as much as a second kickback voltage ΔV2. The second kickback voltage ΔV2 may be a value corresponding to an amplitude of the kickback voltage of the second comparison element.

Since a channel width of the second comparison element is a sum of channel widths of the switching element ST and the dummy element AT, the second comparison element may be larger than the switching element ST in channel width. Accordingly, the kickback voltage of the second comparison element may be higher than a kickback voltage of the switching element ST. Therefore, the second kickback voltage ΔV2 may be higher than the first kickback voltage ΔV1.

Since the second kickback voltage ΔV2 may be higher than the first kickback voltage ΔV1, a level of the first data voltage VD1 charged in the first pixel PX1 may further decrease.

In the embodiment of the inventive concept described with reference to FIGS. 10 and 11, a level of the first data voltage VD1 charged in the first pixel PX1 may decrease by as much as the first kickback voltage ΔV1 which is smaller than the second kickback voltage ΔV2 described in FIG. 12. Accordingly, the first pixel PX1 may be charged with a higher voltage when the switching element ST is used versus when the second comparison element is used.

As a result, the display apparatus described in reference to FIGS. 10 and 11 may be increase a charge rate of the pixels PX.

Figure 13:
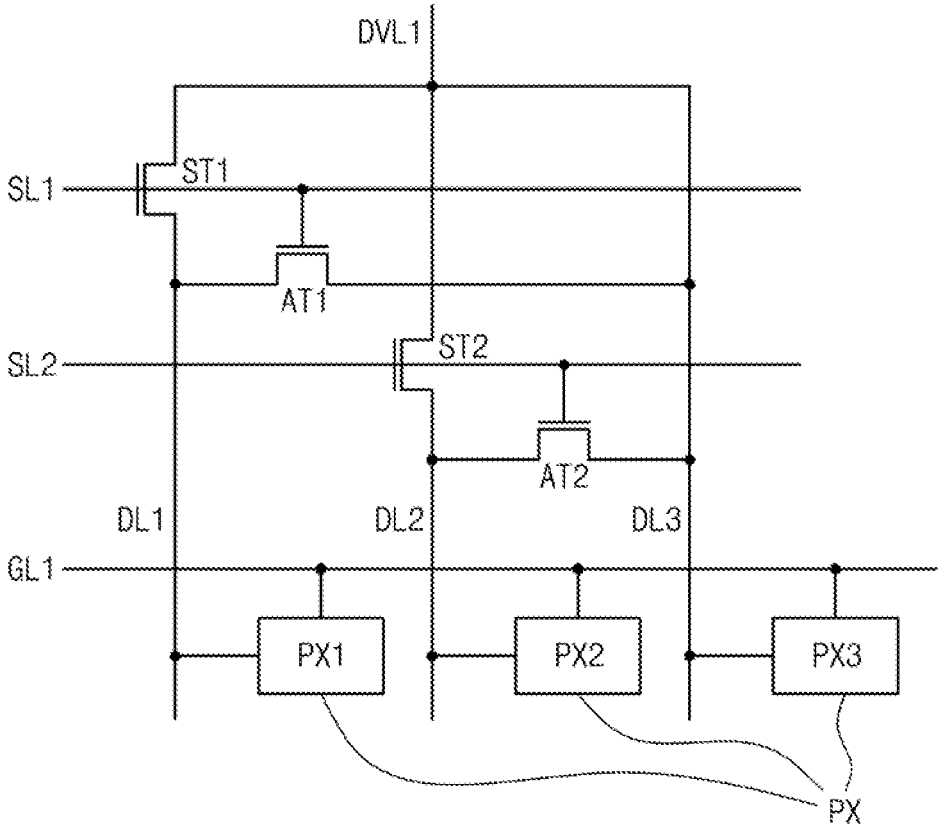
FIG. 13 is a diagram illustrating a part of a demultiplexer of a display apparatus according to an exemplary embodiment of the inventive concept.
Figure 14:
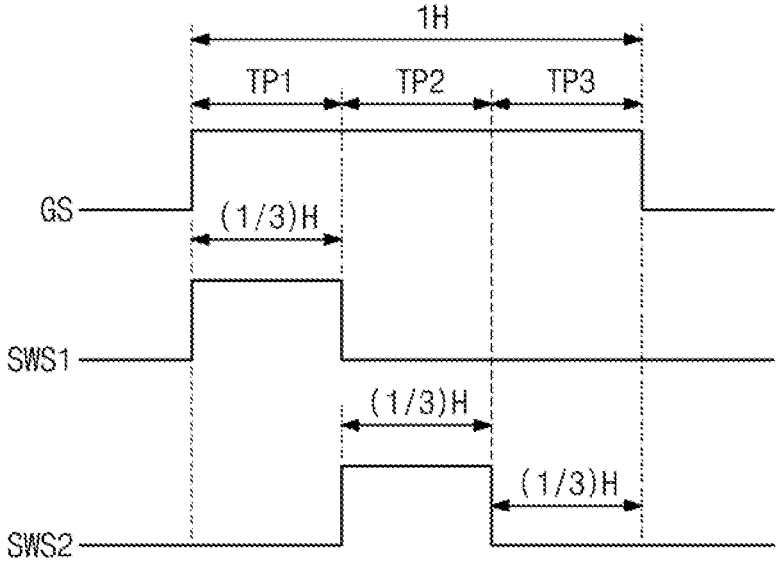
FIG. 14 is a timing diagram illustrating an operation of the demultiplexer shown FIG. 13, according to an exemplary embodiment of the present inventive concept.

FIG. 13 is a diagram illustrating a part of a demultiplexer of a display apparatus according to an exemplary embodiment of the present inventive concept. FIG. 14 is a timing diagram illustrating an operation of the demultiplexer shown FIG. 13, according to an exemplary embodiment of the present inventive concept.

The display apparatus described with reference to FIGS. 13 and 14 may be similar to the display apparatus 100 described with reference to FIGS. 1 to 7, except for a connection of the demultiplexer.

Referring to FIGS. 13 and 14, the demultiplexer may include a plurality of first switching elements ST1, a plurality of second switching elements ST2, a plurality of first dummy elements AT1, and a plurality of second dummy elements AT2.

Additionally, data lines may include a plurality of first data lines DL1 which are also referred to as [3m-2]'th data lines, a plurality of second data lines DL2 which are also referred to as [3m-1]'th data lines, and a plurality of third data lines D3 which are also referred to as 3m'th data lines.

Pixels PX may include a plurality of first pixels PX1 which are connected to the first data lines D1, a plurality of second pixels PX2 which are connected to the second data lines D2, and a plurality of third pixels PX3 which are connected to the third data lines D3.

For convenience of description, FIG. 13 just illustrates first to third data lines DL1~DL3 which are connected to one driving line DVL1, first and second switching elements ST1 and ST2 and first and second dummy elements AT1 and AT2 which are connected to the first to third data lines DL1~DL3, and the first to third pixels PX1~PX3 which are connected to the first to third data lines DL1~DL3.

The first and second switching elements ST1 and ST2 may be larger than the first and second dummy elements AT1 and AT2 in channel width.

The first switching element ST1 may be connected to the driving line DVL1 and the first data line DL1. The second switching element ST2 may be connected to the driving line DVL1 and the second data line DL2. The driving line DVL1 may be connected to the third data line DL3.

The first dummy element AT1 may be connected to the first data line DL1 and the third data line DL3. The second dummy element AT2 may be connected to the second data line DL2 and the third data line DL3.

The first switching element ST1 and the first dummy element AT1 may be connected to a first switching line SL1 which receives a first switching signal SWS1. The second switching element ST2 and the second dummy element AT2 may be connected to a second switching line SL2 which receives a second switching signal SWS2.

The first switching element ST1 may include a control terminal (e.g., a gate terminal) which is connected to the first switching line SL1, an input terminal (e.g., a drain or a source terminal) which is connected to the driving line DVL1, and an output terminal (e.g., a source or a drain terminal) which is connected to the first data line DL1.

The first dummy element AT1 may include a control terminal (e.g., a gate terminal) which is connected to the first switching line SL1, an input terminal (e.g., a drain or a source terminal) which is connected to the third data line DL3, and an output terminal (e.g., a source or a drain terminal) which is connected to the first data line DL1.

The second switching element ST2 may include a control terminal (e.g., a gate terminal) which is connected to the second switching line SL2, an input terminal (e.g., a drain or a source terminal) which is connected to the driving line DVL1, and an output terminal (e.g., a source or a drain terminal) which is connected to the second data line DL2.

The second dummy element AT2 may include a control terminal (e.g., a gate terminal) which is connected to the second switching line SL2, an input terminal (e.g., a drain or a source terminal) which is connected to the third data line DL3, and an output terminal (e.g., a source or a drain terminal) which is connected to the second data line DL2.

A period 1 H of a gate signal GS applied to a gate line GL1 may include a first period TP1, a second period TP2, and a third period TP3. Each of the first, second, and third periods TP1, TP2, and TP3 may be set on (1/3)n. As noted above, n is a natural number.

The first switching signal SWS1 may be provided to the first switching element ST1 and the first dummy element AT1 through the first switching line SL1 during the first period TP1. The first switching element ST1 and the first dummy element AT1 may be turned on in response to the first switching signal SWS1.

During the first period TP1, a first data voltage applied to the driving line DVL1 may be provided to the first pixel PX1, which is connected to the first data line DL1, through the first switching transistor ST1 and the first dummy element AT1 which are turned on. Accordingly, currents flowing through the first switching element ST1 and the first dummy element AT1 may be summed up at the first data line DL1 and provided to the first pixel PX1.

The second switching signal SWS2 may be provided to the second switching element ST2 and the second dummy element AT2 through the second switching line SL2 during the second period TP2. The second switching element ST2 and the second dummy element AT2 may be turned on in response to the second switching signal SWS2.

During the second period TP2, a second data voltage applied to the driving line DVL1 may be provided to the second pixel PX2, which is connected to the second data line DL2, through the second switching transistor ST2 and the second dummy element AT2 which are turned on. Accordingly, currents flowing through the second switching element ST2 and the second dummy element AT2 may be summed up at the second data line DL2 and provided to the second pixel PX2.

During the third period TP3, a third data voltage applied to the driving line DVL1 may be provided to the third pixel PX3 through the third data line DL3.

Since the first pixel PX1 and the second pixel PX2 are provided with currents through the first and second switching elements ST1 and ST2 and the first and second dummy elements AT1 and AT2, charge rates of the first pixel PX1 and the second pixels PX2 may be increased. Since the third pixel PX3 is provided with a current directly through the third data line, a charge rate of the third pixel PX3 may be increased.

Consequently, the display apparatus described with reference to FIGS. 13 and 14 may increase a charge rate of the pixels PX.

While the present inventive concept has been shown and described with reference to exemplary embodiments thereof, it will be understood by those of ordinary skill in the art that various changes and modifications may be made thereto without departing from the scope of the inventive concept as hereinafter claimed.

What is claimed is:

1. A display apparatus comprising:

a plurality of gate lines;

a plurality of data lines, wherein the plurality of data lines include a plurality of first and second data line pairs;

a plurality of pixels connected to the gate lines and the data lines;

driving lines connected to the second data lines;

a plurality of switching elements connected to the first data lines and the driving lines; and a plurality of dummy elements respectively connected to a corresponding pair of the first and second data lines, wherein the switching elements and the dummy elements are configured to be turned on in response to a switching signal.

2. The display apparatus according to claim 1, further comprising: a switching line connected to the switching elements and the dummy elements and configured to receive the switching signal.

3. The display apparatus according to claim 2, wherein at least one of the switching elements comprises:

a control terminal connected to the switching line;

an input terminal connected to a corresponding driving line of the driving lines; and an output terminal connected to a first data line of the corresponding pair of the first and second data lines.

4. The display apparatus according to claim 2, wherein at least one of the dummy elements comprises:

a control terminal connected to the switching line;

an input terminal connected to a second data line of the corresponding pair of the first and second data lines; and an output terminal connected to a first data line of the corresponding pair of the first and second data lines.

5. The display apparatus according to claim 1, wherein a channel width of at least one of the switching element is larger than a channel width of at least one of the dummy element.

6. The display apparatus according to claim 1, wherein the switching elements and the dummy elements comprise amorphous silicon thin-film transistors or oxide thin-film transistors.

7. The display apparatus according to claim 1, further comprising:

a display panel in which the pixels are disposed;

a gate driver connected to the gate lines to output gate signals;

a data driver connected to the driving lines to output data voltages; and a demultiplexer disposed between the data driver and the pixels, wherein the demultiplexer includes the switching elements and the dummy elements.

8. The display apparatus according to claim 1, wherein the gate lines are configured to receive gate signals, the driving lines are configured to receive data voltages, and the pixels are configured to be charged with the data voltages which are provided through the driving lines and the first and second data lines in response to the gate signals.

9. The display apparatus according to claim 8, wherein the pixels comprise:

a plurality of first pixels connected to the first data lines; and a plurality of second pixels connected to the second data lines.

10. The display apparatus according to claim 9, wherein at least one period of the gate signals comprises:

a first period in which the first pixels are charged; and a second period in which the second pixels are charged.

11. The display apparatus according to claim 10, wherein the switching signal is provided to the switching elements and the dummy elements during the first period.

12. The display apparatus according to claim 10, wherein the first period is about 0.5 to about 0.9 times of a period of the gate signal.

13. The display apparatus according to claim 10, wherein the switching signal comprises:

a first switching signal provided to the switching elements during the first period; and a dummy switching signal provided to the dummy elements, wherein the dummy switching signal overlaps with the first switching signal in a subperiod of the first period.

14. The display apparatus according to claim 13, further comprising: a dummy switching line connected to the dummy elements to receive the dummy switching signal.

15. The display apparatus according to claim 13, wherein the first period comprises a first subperiod, a second subperiod, and a third subperiod, the second subperiod is interposed between the first subperiod and the third subperiod, and the dummy switching signal is provided to the dummy elements during the second subperiod.

* * * * *